US006413059B1

(12) United States Patent
Pringle

(10) Patent No.: US 6,413,059 B1
(45) Date of Patent: Jul. 2, 2002

(54) LINEARIZED PERISTALTIC PUMP

(75) Inventor: James Thomas Pringle, Greensborough (AU)

(73) Assignee: University of Melbourne, Victoria (AU)

( * ) Notice: Subject to any disclaimer, the term of this patent is extended or adjusted under 35 U.S.C. 154(b) by 0 days.

(21) Appl. No.: 09/622,496

(22) PCT Filed: Feb. 18, 1999

(86) PCT No.: PCT/AU99/00093

§ 371 (c)(1),
(2), (4) Date: Aug. 17, 2000

(87) PCT Pub. No.: WO99/42726

PCT Pub. Date: Aug. 26, 1999

(30) Foreign Application Priority Data

Feb. 19, 1998 (AU) ..... PP1920

(51) Int. Cl.[7] ..... F04B 43/08

(52) U.S. Cl. ..... 417/477.1; 417/474; 417/475; 417/476

(58) Field of Search ..... 417/474, 475, 417/476, 477.1

(56) References Cited

U.S. PATENT DOCUMENTS

| | | | | |
|---|---|---|---|---|
| 2,804,023 | A | 8/1957 | Lee | 103/149 |
| 2,977,890 | A | 4/1961 | Seyler | 103/149 |
| 3,137,242 | A | 6/1964 | Hahn | 103/152 |
| 3,960,466 | A | 6/1976 | Taylor | 417/234 |
| 4,025,241 | A | 5/1977 | Clemens | 417/477 |
| 4,029,441 | A | 6/1977 | Fischer | 417/477 |
| 4,552,516 | A | 11/1985 | Stanley | 417/477 |
| 4,564,342 | A | 1/1986 | Weber et al. | 417/477 |
| 5,350,284 | A | 9/1994 | Wehling | 417/474 |

FOREIGN PATENT DOCUMENTS

| | | |
|---|---|---|
| AU | B 21085/88 | 2/1989 |
| AU | B 58873/90 | 6/1991 |
| AU | A 11538 | 8/1995 |
| DE | 1951347 | 10/1969 |
| DE | 3737023 A1 | 10/1987 |
| FR | 2707703 A1 | 1/1995 |
| GB | 1580514 | 12/1980 |
| GB | 2076068 A | 11/1981 |
| GB | 2102503 A | 2/1983 |
| GB | 2 115 498 A | 9/1983 |
| GB | 2226601 A | 7/1990 |
| SU | 1222886 A | 4/1986 |
| SU | 1244377 A | 7/1986 |
| SU | 1408150 A | 7/1988 |
| SU | 1643783 A | 4/1991 |
| WO | WO 86/06796 | 11/1986 |
| WO | WO 93/24755 | 12/1993 |

*Primary Examiner*—Charles G. Freay
*Assistant Examiner*—E Hayes
(74) *Attorney, Agent, or Firm*—Townsend and Townsend and Crew LLP

(57) ABSTRACT

A linearized peristaltic pump has a substantially circular elastomeric tube (30) clamped within a pump housing (1) and a plurality of tube-engaging rollers (40) adapted to compress the tube (30) to pump fluid from an inlet end (33) to an outlet end (34). The tube (30) is clamped longitudinally by a circlip (35) so as to have a flattened clamped part (31) and a bulbous unclamped part (32) which is engaged by the rollers (40). The rollers (40) are mounted on the outer ends of spring-loaded rotor arms (42) and move on a cam track (50) to alter the compression of the tube (30) progressively in a tube-encountering sector (E-B) and a tube-releasing sector (C-A).

18 Claims, 3 Drawing Sheets

LINEARIZED PERISTALTIC PUMP

This invention relates to peristaltic pumps, and is particularly concerned with providing an improved peristaltic pump in which pulsatility is substantially reduced.

The necessities of having positive displacement of fluids, uninterrupted flow, little or no pulsatility and good linearity of delivery are usually seen as mutually exclusive criteria for pump design. The linear but cyclic delivery of a syringe-type pump or the pulsatile but continuous output of gear or vane pumps require unacceptable compromises for some applications, especially when complex and expensive pump types are precluded. Additional requirements of zero leak-through, ease of manufacture, low maintenance, low cost and precise delivery rates place additional burdens on design approach.

Peristaltic pumps arc usually simple in construction, have intrinsic valving and little or no leak-through, require low driving forces, provide positive delivery, have uninterrupted fluid paths, and are also suitable for pumping aggressive fluids. However, conventional peristaltic pumps generally suffer from pulsatility and chaotic delivery rates. It is therefore desirable to provide a peristaltic pump in which at least some of the disadvantages of non-linear peristaltic pumps are alleviated.

It is also desirable to provide a linearised peristaltic pump that is inexpensive and simple to manufacture and assemble.

It is also desirable to provide a positive displacement peristaltic pump that has negligible pulsatility and which can provide a consistent delivery of fluid.

According to one aspect of the invention there is provided a linearised peristaltic pump comprising a pump housing, a tube within the pump housing, and tube-engaging means adapted to engage with the tube to pump fluid from an inlet end of the tube to an outlet end of the tube, wherein the tube is clamped longitudinally within the housing in such a manner as to reduce the internal cross-sectional area of the tube.

Preferably, the tube is clamped longitudinally by clamping means over part of its transverse dimension so as to have a substantially flattened clamped part and a bulbous unclamped part. In its clamped condition the cross-sectional shape of the tube generally resembles a letter "P". The tube engaging-means is arranged to engage and compress the bulbous unclamped part of the tube to pump fluid along the tube. By clamping the tube longitudinally in this manner, all but the desired deformations of the tube required for pumping are substantially eliminated removing one of the major sources of non-linearity in peristaltic pumps.

The tube-engaging means may take any convenient form which is arranged to engage and compress the tube progressively between its inlet end and outlet end. Conveniently, the tube-engaging means comprises a plurality of tube-engaging members, preferably in the form of rollers, movable within the housing relative to the clamped tube. The tube-engaging members are preferably arranged to engage and compress the tube during only part of its length between its inlet and outlet ends. The tube is preferably engaged progressively by the tube engaging members in a first tube-encountering sector, fully compressed in a second, fluid-displacing sector in which the lumen of the tube is completely closed, and then allowed to relax progressively in a third, tube-releasing sector to resume its uncompressed, clamped cross-section. This controlled encounter and release of the tube reduces the fluid-displacing volume of the pump but has the advantage of reducing flow variations and pulsatility to negligible levels.

Preferably, the fluid-displacing sector is of substantially equal size to the tube-encountering and tube releasing sectors.

In a particularly preferred embodiment, a plurality of tube-engaging rollers compress the tube during the fluid-displacing sector and are movable on a cam track during the first, tube-encountering and third, tube-releasing sectors so that the compression of the tube is altered progressively as the rollers move within the first and third sectors.

According to another aspect of the invention there is provided a linearised peristaltic pump comprising a pump housing, a tube located within the housing, and a plurality of tube-engaging rollers engageable with the tube to compress the tube to pump fluid from an inlet end of the tube to an outlet end of the tube, wherein the rollers are movable on a single cam track having a single tube-encountering sector in which the compression of the tube is increased progressively to alter the cross-sectional area of the tube in a linear manner, a single fluid-displacing sector in which the tube is fully compressed, and a single tube-releasing sector in which the compression of the tube is decreased progressively to alter the cross-sectional area of the tube in a linear manner, wherein the tube-encountering and tube-releasing sectors of the cam track are of substantially the same length to achieve a substantially linear and pulseless fluid delivery.

A linear peristaltic pump having a substantially straight tube may be provided in accordance with the invention, but preferably the linearised peristaltic pump is a rotary pump having a tube which occupies a substantially circular path within the pump housing, the tube being engageable by a plurality of tube-engaging members rotatable within the pump housing. The tube may be conveniently clamped between a clamping member and a wall of the housing. Preferably, the tube-engaging members comprise rollers which are mounted on the ends of arms connected to a rotary member rotatable about the central axis of the housing. The rollers are preferably spring urged in a radially outwards direction into contact with the cam track during the tube-encountering, fluid-displacing and tube-releasing sectors. A pump of this construction is simple and relatively inexpensive to manufacture and assemble and can provide a consistent delivery with negligible pulsatility.

In a preferred embodiment, the tube is fully compressed in the fluid-displacing sector which occupies approximately one third of the circumference of the substantially circular arc of the tube.

A preferred embodiment of the invention will now be described, by way of example only, with reference to the accompanying drawings, in which.

Figure 1:
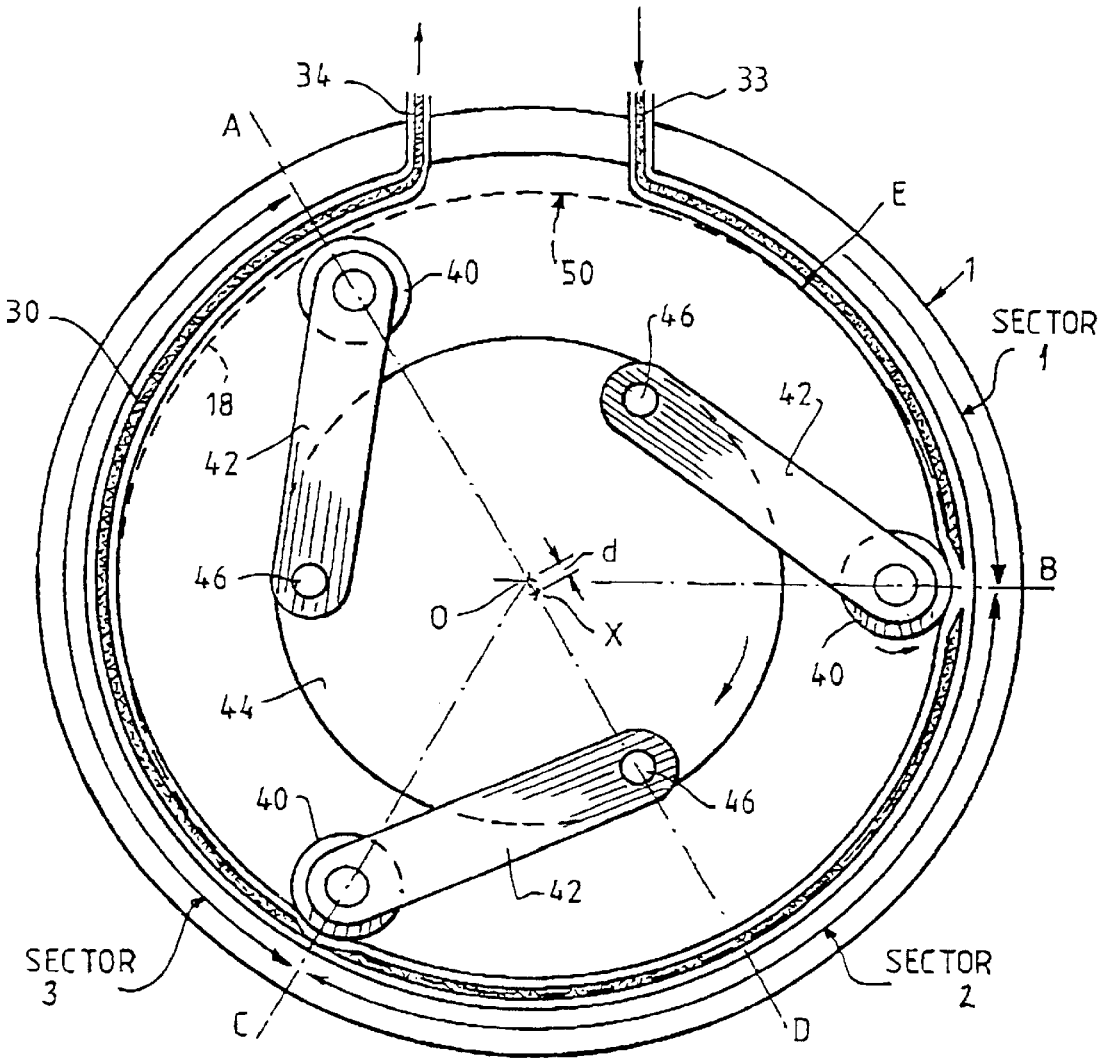
FIG. 1 is a schematic plan view of a linearised peristaltic pump with part of the housing removed.

The linearised peristaltic pump shown in the drawings comprises a pump housing 1 having first and second housing parts 10 and 20 respectively, an elastomeric tube 30 clamped within the housing 10 and a plurality of tube-engaging rollers 40.

The first housing, part 10 is in the form of a substantially circular plate 12 having a generally annular flange 14 at or adjacent to its periphery 15. The flange has circular outer surface 16 and an eccentric inner surface 18. The second housing part 20 is in the form of a circular closure plate 22 with a depending peripheral annular side wall 24. The side wall 24 is of stepped form having a thicker intermediate portion 26 between a first end portion 28 adjacent the closure plate 22 and a second end portion 29 which abuts the peripheral region 15 of the first housing part 10.

As shown in FIGS. 2 to 5, the tube 30 is clamped longitudinally in the housing by a clamping ring 35. The clamping ring 35 comprises a circlip which is generally L-shaped in cross-section having an outwardly extending peripheral portion 36 and an annular clamping portion 38. The peripheral portion 36 is received between the intermediate portion 26 and the closure plate 22 of the second housing part 20.

The clamping portion 38 of the circlip 35 is arranged to clamp and compress approximately half of the width of the tube 30 between the radially outer cylindrical surface of the clamping portion 38 and the thicker intermediate portion 26 of the side wall of the second housing part 20. With about half of the tube 30 clamped in this manner, the tube 30 is deformed so that it is generally P-shaped in cross-section having a generally flat clamped part 31 and a bulbous part 32 engageable by rollers 40.

The tube-engaging rollers 40 are rotatably mounted on the ends of roller arms 42 the other ends of which are pivotally connected to a circular rotary member in the form of a disc 44 mounted for rotation about the centre O of housing 1. The roller arms 42 extend substantially tangentially to the disc 44 and are connected to the disc 44 by spring-loaded pivotal connections 46 which urge the rollers 40 outwardly into contact with a cam track 50 formed by the eccentric inner surface 18 of the raised flange 14 of the first housing part 10. As shown in FIG. 1, the cam track axis X is offset from the central axis O of rotation of the rotary disc member 44 by a distance d.

As shown in FIG. 1, the clamped tube 30 occupies almost a complete circular path around the central axis of the housing and has an inlet portion 33 extending through an opening in the housing to an inlet port (not shown) and an outlet portion 34 extending outwardly through an opening in the housing to an outlet port (not shown) of the pump. In use, the inlet port of the pump is connected to a source of fluid and the outlet port is connected to a chamber or vessel to receive fluid from the pump.

Figure 2:
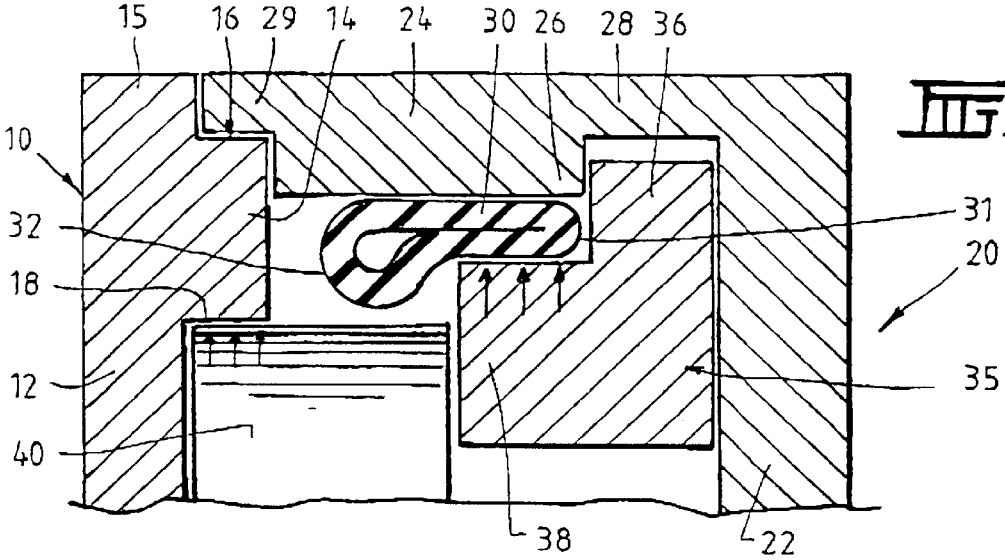
FIG. 2 is a sectional view at position A of FIG. 1.

The eccentricity of the cam track is such that the eccentric inwardly facing surface 18 of the first housing part forming the cam track 50 is closest to the central axis O of the pump housing at circumferential position just before the outlet portion 34 of the tube leaves the pump housing 1 indicated by position A in FIGS. 1 and 2, and in a diametrically opposite position D the inwardly facing surface 18 is farthest away from the central axis O.

The offset d of the cam track axis is such that in position A the inwardly facing surface 18 of the cam track 50 is closer to the central axis O of the pump housing than the wall of the bulbous part 32 of the tube 30, whereas in the diametrically opposite position D, the inwardly facing surface 18 of the cam track 50 is approximately level with the radially inwardly facing surface of the thicker intermediate portion 26 of the pump housing. The arrangement is such that the tube-engaging rollers 40 engage the tube 30 fully in a fluid-displacing sector extending over approximately one third of the circumference of the pump housing 1 on either side of position D between positions B and C, and the rollers 40 engage the cam track over the remainder of the circumference of the pump housing 1 on either side of position A. As shown in FIGS. 2 to 5, the rollers 40 are sufficiently wide to compress the tube 30 and to engage the cam track.

Figure 4:
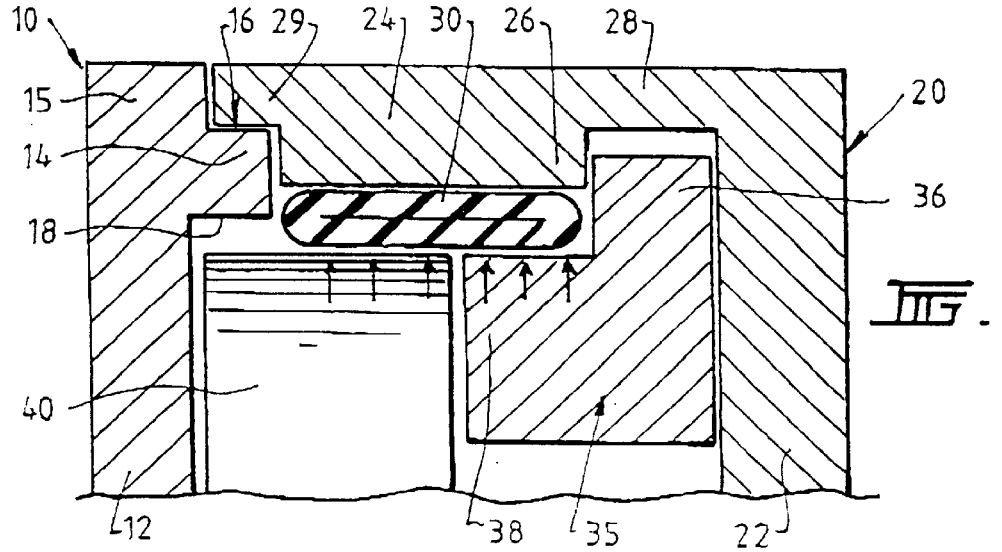
FIG. 4 is a sectional view at position C of FIG. 1.
Figure 5:
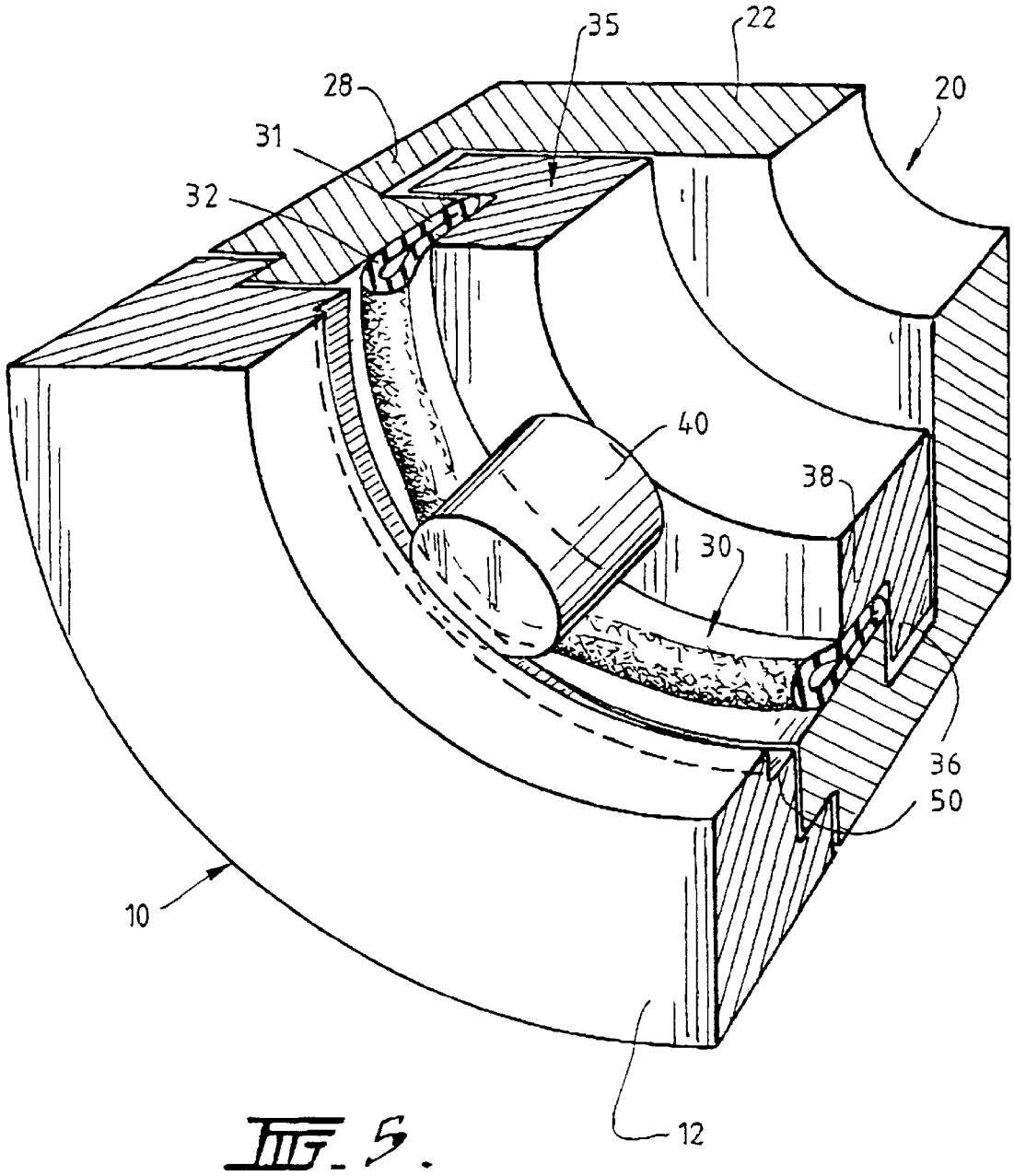
FIG. 5 is a schematic internal perspective view of part of the pump of FIG. 1.

In operation, the rotary disc member 44 of the pump is rotatably driven by any convenient drive means, such as a low power D.C. electric motor or a stepping motor. As the disc member 44 rotates (in the clockwise direction as shown in FIG. 1) each roller 40 in turn moving on the cam track starts to engage the tube 30 at a circumferential position E soon after the position at which the inlet portion 33 of the tube enters the pump housing 1. The roller 40 then compresses or "crimps" the bulbous region 32 of the tube progressively in a first, tube-encountering sector E-B until position B when the tube 30 is fully compressed by the roller 49 which is no longer in engagement with the cam track 50 as shown in FIG. 4.

Figure 3:
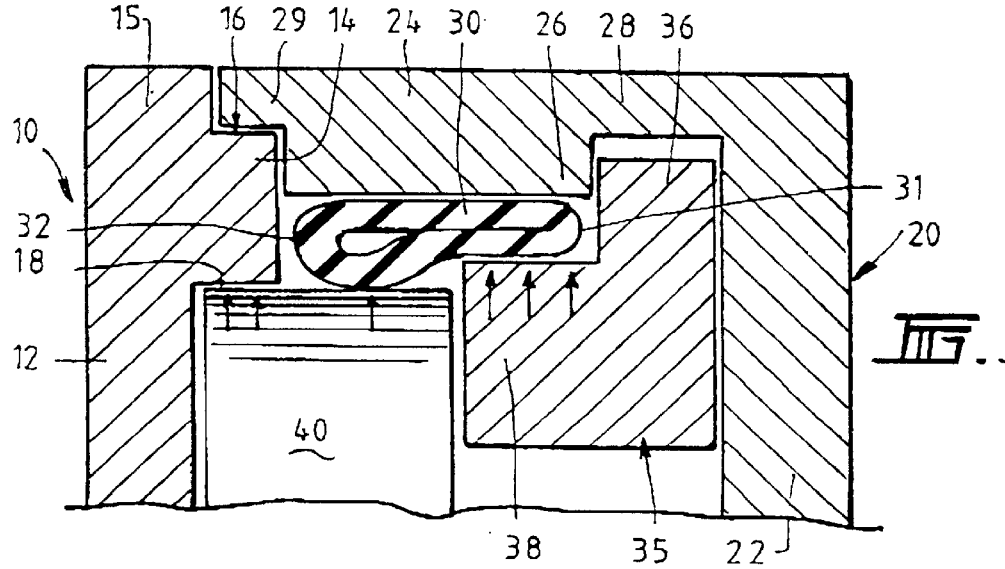
FIG. 3 is a sectional view at position B of FIG. 1.

The roller 40 continues to camp the tube 30 fully as it moves in the second, fluid-displacing sector past position D until it comes into contact again with the cam track in position C as shown in FIG. 3. Crimping of the tube then ceases and the tube 30 is progressively allowed to regain its normal uncrimped cross-section as the roller 40 moves in a third tube-releasing sector. As shown in FIG. 2, the tube 30 has fully relaxed to 34 its normal uncrimped cross-section in position A just before the outlet portion 34 of the tube 30 leaves the housing 1.

Allowing the pumping tube 30 to relax in a progressive, controlled manner to its normal uncrimped cross-section before the outlet portion 34 of the tube 30 leaves the housing 1 has the effect of not only linearly reducing the output volume per revolution but also reducing flow variations to negligible levels. The longitudinal clamping of the tube 30 by the clamping ring 35 locates the tube 30 accurately and holds the tube 30 securely against the shear forces of the rollers 40. The clamping of the tube 30 in its generally P-shaped cross-sectional form eliminates all but the desired deformations of the tube during pumping, and so an inexpensive, thin-walled tubing may be used instead of an expensive, specially moulded silicone rubber tubing.

It can be seen that the delivery rate is the main delivery volume less the delivery-reducing stroke of the departing roller. By suitable profiling of the cam track, the smooth arrival and departure of the rollers and therefore the smooth aspiration of the inlet and outlet volumes can be achieved.

The advantages of a pump as described above in accordance with the invention are several. Readily available, standard components such as elastomeric tubing and rollers can be used and so the pump is relatively inexpensive to manufacture. The pump does not include any valves, uses resilient plastic rotor arms instead of springs, and is simple to make and assemble. The elastomeric tube is immune to aggressive fluids. The pump is self priming and provides positive displacement with an unbroken fluid path, no "leak trough" or vapour locking. It provides a consistent delivery with negligible pulsatility. The pump has low power requirements, requires little or no maintenance and can be made in different sizes for different requirements.

It will be appreciated that various modifications may be made to the embodiment described above without departing from the scope or spirit of the invention. For example, whilst the embodiment shown in the drawings has three tube-engaging rollers, a different number of rollers may be provided. Also, whilst simple shaping of the cam track can be employed to attain adequate linearity, highly precise cam track profiling can be used to attain substantially perfect linearity.

What is claimed is:

1. A linearised peristaltic pump comprising:

a pump housing, a tube within the pump housing, tube-engaging means adapted to engage the tube and moveable within the housing to pump fluid from an inlet end of the tube to an outlet end of the tube, and tube-clamping means for clamping the tube longitudinally along the length of the tube within the housing in such a manner as to reduce the internal cross-sectional area of the tube.

2. A pump according to claim 1 wherein the tube-clamping means clamps the tube over part of its transverse dimension so as to have a substantially flattened clamped part of a bulbous unclamped part.

3. A pump according to claim 2 wherein the tube-engaging means is arranged to compress the bulbous unclamped part of the tube between the inlet end and the outlet end of the tube.

4. A pump according to claim 3 wherein the tube-engaging means is arranged to compress the tube during only part of its length between the inlet and outlet ends of the tube.

5. A pump according to claim 4 wherein the tube is engaged progressively by the tube-engaging means in a first, tube-encountering sector, fully compressed in a second, fluid displacing sector and then allowed to relax progressively in a third, tube-releasing or to resume its uncompressed, clamped cross-section.

6. A pump according to claim 1 wherein the tube-engaging means comprises a plurality of the tube-engaging members movable within the housing relative to the clamped tube.

7. A pump according to claim 6 wherein the tube-engaging members are in the form of rollers movable on a cam track during tube-encountering and tube-releasing sectors to alter the compression of the tube progressively as the rollers move within those sectors.

8. A linearised peristaltic pump comprising a pump housing, a tube located within the housing, and a plurality of tube-engaging rollers engageable with the tube to compress the tube to pump fluid from an inlet end of the tube to an outlet end of the tube, wherein the rollers are movable on a single cam track having a single tube-encountering sector in which the compression of the tube engaged by the rollers is increased progressively to alter the cross-sectional area of the tube in a linear manner, a single fluid-displacing sector in which the tube is fully compressed, and a single tube-releasing sector in which the compression of the tube is decreased progressively to alter the cross-sectional area of the tube in a linear manner wherein the tube-encountering and tube-releasing sectors of the cam track are of substantially the same length to achieve a substantially linear and pulseless fluid delivery.

9. A pump according to claim 7 wherein the pump is a rotary pump having a tube which occupies a substantially circular, arcuate path within the pump housing, the plurality of tube-engaging rollers being movable on an eccentric surface within he pump housing.

10. A pump according to claim 9 wherein the tube is clamped longitudinally along its length between a clamping member and a wall of the housing.

11. A pump according to claim 10 wherein the clamping member comprises a circlip which clamps part of the tube against an annular wall of the housing.

12. A pump according to claim 9 wherein the tube-engaging rollers are mounted to a rotary member rotatable about the central axis of the housing.

13. A pump according to claim 12 wherein the rollers are urged in a radially outwards direction into contact with the cam track during the tube-encountering, fluid-displacing and tube-releasing sectors.

14. A pump according to claim 13 wherein the fluid-displacing sector extends over approximately one third of the circumference of the substantially circular arc of the tube.

15. A pump according to claim 14 wherein the tube-encountering and tube-releasing sectors during which the rollers move on the cam track each extend over approximately one third of the circumference of the substantially circular arc of the tube.

16. A pump according to any one of claims 11 to 15 wherein three rollers are mounted to the rotary member at circumferentially spaced locations around the rotary member.

17. A pump according to claim 9 wherein the rollers are mounted on the outer ends of resilient arms extending generally tangentially to the rotary member, the inner ends of the arms being connected to the rotary member by spring-loaded pivotal connections which urge the rollers on outer ends of the arms in a radially outwards direction.

18. A pump according to claim 1 wherein the tube is formed of an elastomeric material.

* * * * *